US006318231B1

(12) United States Patent
Kart

(10) Patent No.: US 6,318,231 B1
(45) Date of Patent: Nov. 20, 2001

(54) SEMI-AUTOMATIC PISTOL BARREL WITH PRECISION BARREL MUZZLE BUSHINGS AND METHOD

(76) Inventor: Frederick H. Kart, 1697 Lawndale Dr., Shalotte, NC (US) 28470

( * ) Notice: Subject to any disclaimer, the term of this patent is extended or adjusted under 35 U.S.C. 154(b) by 0 days.

(21) Appl. No.: 09/426,604

(22) Filed: Oct. 26, 1999

Related U.S. Application Data

(60) Provisional application No. 60/105,966, filed on Oct. 28, 1998.

(51) Int. Cl.[7] ..... F41A 3/14
(52) U.S. Cl. ..... 89/163; 89/187.01
(58) Field of Search ..... 89/163, 171, 187.01, 89/198

(56) References Cited

U.S. PATENT DOCUMENTS 5,076,139 * 12/1991 Hiett ..... 89/198
5,501,135 * 3/1996 Beretta ..... 89/163
5,952,602 * 9/1999 Beretta ..... 89/163

FOREIGN PATENT DOCUMENTS

673028 * 5/1952 (GB) ..... 89/163

* cited by examiner

*Primary Examiner*—Stephen M. Johnson
(74) *Attorney, Agent, or Firm*—Adams, Schwartz & Evans, P.A.

(57) ABSTRACT

A barrel bushing for a semi-automatic pistol. The barrel bushing defines a bore for receiving a barrel therein for reciprocating movement during operation of the pistol. The improvement to the barrel bushing comprises first, second and third annular bearing surfaces formed on inner walls of the bore and against which the barrel moves during operation of the pistol. The first bearing surface contacts and supports the barrel during the recoil phase of operation, and defines a plane parallel to the longitudinal axis of the barrel during recoil. The second and third bearing surfaces reside in axially spaced-apart relation on opposite axially-extending sides of the first bearing surface and define respective planes with respect to the first bearing surface which are parallel to the longitudinal axis of the barrel during lockup and on which opposite upper and lower surfaces of the barrel are supported during lockup. A method of manufacturing the barrel bushing is also disclosed.

12 Claims, 7 Drawing Sheets

IN RECOIL

AT LOCKUP

SEMI-AUTOMATIC PISTOL BARREL WITH PRECISION BARREL MUZZLE BUSHINGS AND METHOD

This application claims priority from provisional application Ser. No. 60/105,966, filed on Oct. 28, 1998.

TECHNICAL FIELD AND BACKGROUND OF THE INVENTION

This invention relates to firearms and more particularly to semi-automatic, or autoloading pistols. This application discloses a precision barrel muzzle bushing and a method of producing the bushing.

A very popular model of semi-automatic pistol is the U.S. caliber .45 model 1911 pistol as made by Colt, Remington, Ithaca Gun Company and others with an estimated several million having been made from 1911 to date. Other autoloading pistols of generally similar design are the Browning Model P35, the Smith and Wesson Model 39, the Polish Radom and the Russian M1933 Tokarev. In general, the invention has application to any semi-automatic 45, 40 or 38 caliber pistol, as well as 9 and 10 mm pistols, such as the 9 mm Beretta currently used by the United States and some other NATO armed forces, in which the barrel is moved into a battery, or lock-up, position by means of a lug link or camming surface.

In all of these pistols the barrel and slide are separate parts with the barrel unlocking itself from the slide, which includes the bolt, as the slide moves to the rear in response to at firing. This design inherently causes a heavy recoil and firing inaccuracy because the barrel and sights are not integral. Moreover, because many of these weapons are made to be used in combat circumstances where fouling by dirt, grease and other contaminants may occur without the opportunity for frequent cleaning, tolerances between critical operating parts such as the shell ejection opening and barrel hood, the barrel and receiver housing, and the barrel and slide locking grooves are deliberately greater than necessary to achieve optimum firing accuracy and reliability in order to permit operation even when fouled, and to permit easy field disassembly and repair.

A standard 45 caliber Colt when properly adjusted with no worn or damaged parts when bench fired will hit a target at 50 feet with a spread of approximately 6 inches (15 cm). The barrel of such a handgun is actually permitted to move a few thousandths of an inch during firing and is not held rigid. A few thousandths of an inch movement of the barrel easily results in a several inch variation in movement of the projectile at fifty feet. This means that only chance will result in a firing pattern significantly tighter than 6 inches (15 cm). Manufacturing variations between components of various manufacturers and rebuilders also introduce a further degree of inaccuracy into the operation of the pistol.

The continuing popularity and availability of these pistols has resulted in their use for sport target competition, and as weapons for special military and police units where enhanced accuracy is necessary or desirable. This invention provides a novel barrel muzzle bushing which permits proper movement of the barrel into and out of lockup, while providing enhanced accuracy and protection to the barrel against damage.

SUMMARY OF THE INVENTION

Therefore, it is an object of the invention to provide a barrel bushing for semi-automatic pistols which enhances the accuracy of the pistol.

It is another object of the invention to provide a barrel bushing for semi-automatic pistols which reduces wear to the moving parts of the pistol.

It is another object of the invention to provide a barrel bushing for semi-automatic pistols which reduces the possibility of damage to the pistol.

These and other objects of the present invention are achieved in the preferred embodiments disclosed below by providing a barrel bushing for a semi-automatic pistol. The barrel bushing defines a bore for receiving a barrel therein for reciprocating movement during operation of the pistol. The improvement to the barrel bushing comprises first, second and third annular bearing surfaces formed on inner walls of the bore and against which the barrel moves dining operation of the pistol. The first bearing surface contacts and supports the barrel during the recoil phase of operation, and defines a plane parallel to the longitudinal axis of the barrel during recoil. The second and third bearing surfaces reside in axially spaced-apart relation on opposite axially-extending sides of the first bearing surface and define respective planes with respect to the first bearing surface which are parallel to the longitudinal axis of the barrel during lockup and on which opposite upper and lower surfaces of the barrel are supported during lockup.

According to one preferred embodiment of the invention, the first bearing surface defines an axial length which is 22 percent the length of each of the second and third bearing surfaces.

According to another preferred embodiment of the invention, the second and third bearing surfaces each reside at an angle of 0°52' with reference to the first bearing surface.

According to yet another preferred embodiment of the invention, the invention comprises a semi-automatic pistol in combination with a barrel bushing as claimed and described herein.

Preferably, the pistol comprises a Colt 45 caliber semi-automatic pistol.

An embodiment of the method of manufacturing a barrel bushing according to the invention comprises the steps of forming a first bearing surface contacting and supporting the barrel during the recoil phase of operation, the first bearing surface defining a plane parallel to) the longitudinal axis of the barrel during recoil, and forming a second and third bearing surfaces in axially spaced-apart relation on opposite axially-extending sides of the first bearing surface, and defining respective planes which are parallel to the longitudinal axis of the barrel during lockup and on which opposite upper and lower surfaces of the barrel are supported during lockup.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
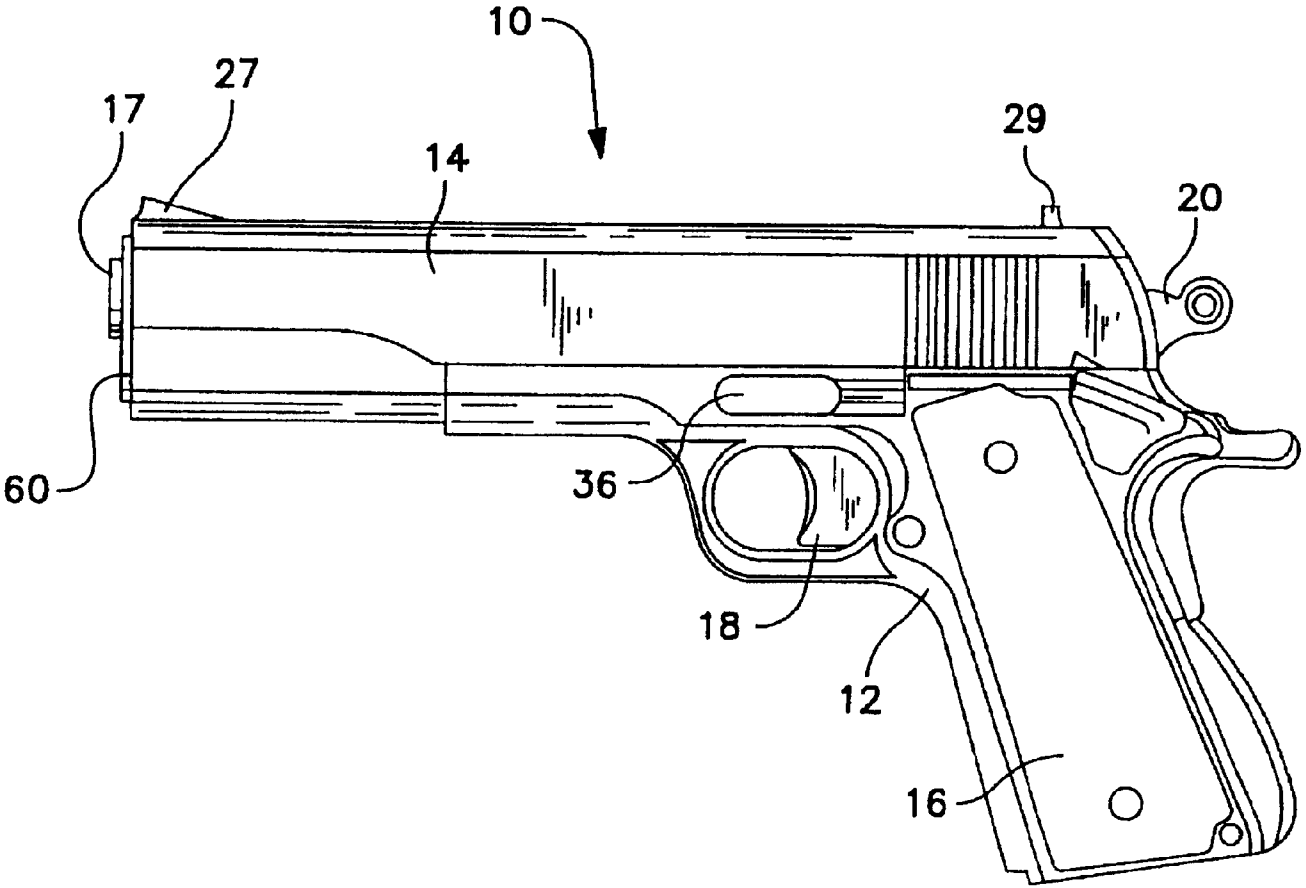
FIG. 1 is a side elevation of a U.S. caliber .45 model 1911 semi-automatic pistol.
Figure 2:
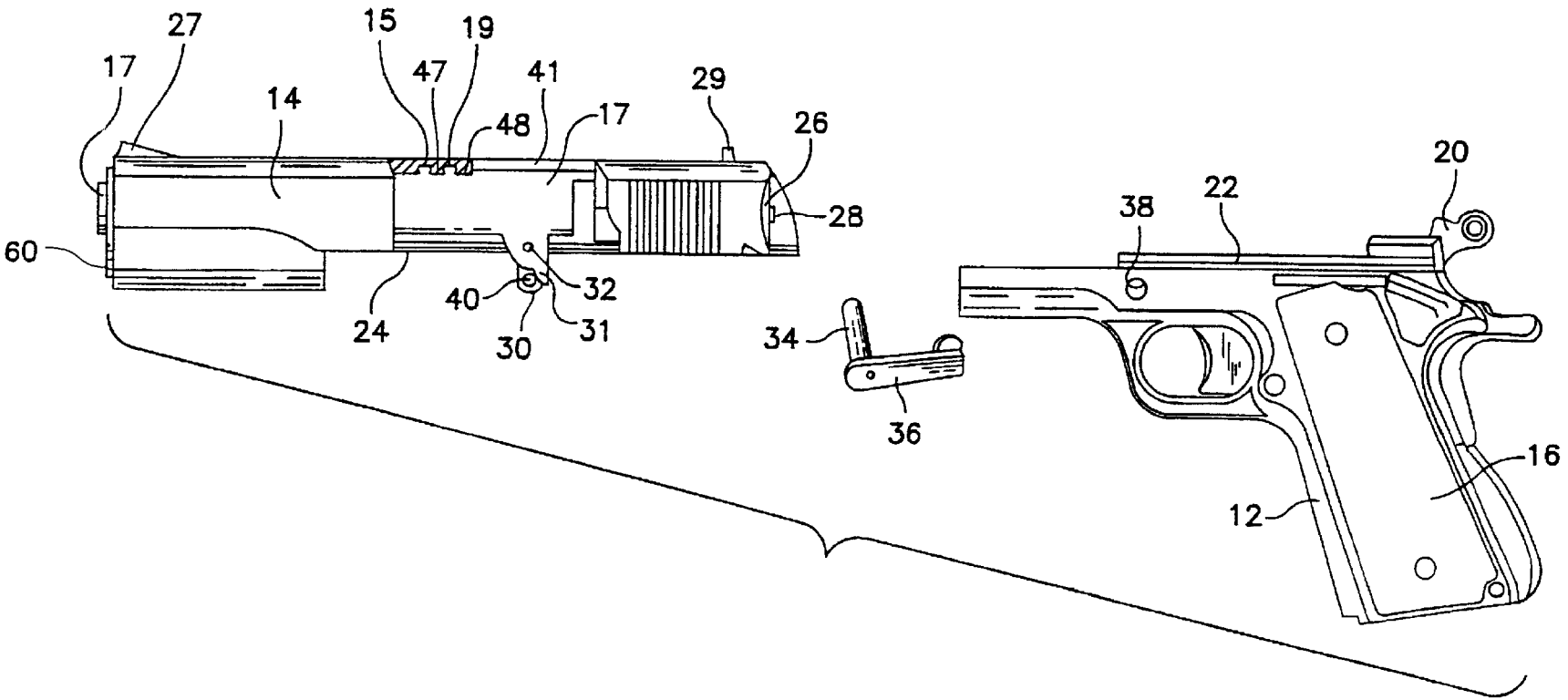
FIG. 2 is a partially-exploded view of the pistol shown in FIG. 1, with the slide removed from the receiver.

Referring now specifically to the drawings, a 45 caliber semi-automatic pistol of conventional manufacture is illustrated in FIGS. 1 and 2 and shown generally at reference numeral 10. Pistol 10 is broadly formed of a receiver 12, slide 14, and barrel 17. The receiver 12 has a grip 16 and carries a trigger mechanism including a trigger 18 and hammer 20, as well as a magazine 21 (FIG. 4) which holds cartridges to be fed one-by-one into the firing chamber of the pistol.

Referring now specifically to FIG. 2, the slide 14 of the pistol 10 is supported on the receiver 12 for fore-to-aft sliding movement by a pair of longitudinally extending guide rails 22 on the receiver and a matching pair of guide rails 24 on the slide. The slide 14 has a bolt 26 rigidly, that is immovably, fixed to it carrying a firing pin 28 for cooperation with the hammer 20. Front and rear sights 27 and 29 are integral with the slide.

The barrel 17 is slidable and tiltable relative to the slide 14 and is connected to the receiver 12 through a link 30 pivotally connected to an integrally-formed link lug 31 formed on the barrel 17 by a pin 32. The barrel 17 is also pivotally connected to the receiver 12 by a pin 34 of a slide stop 36.

Figure 3:
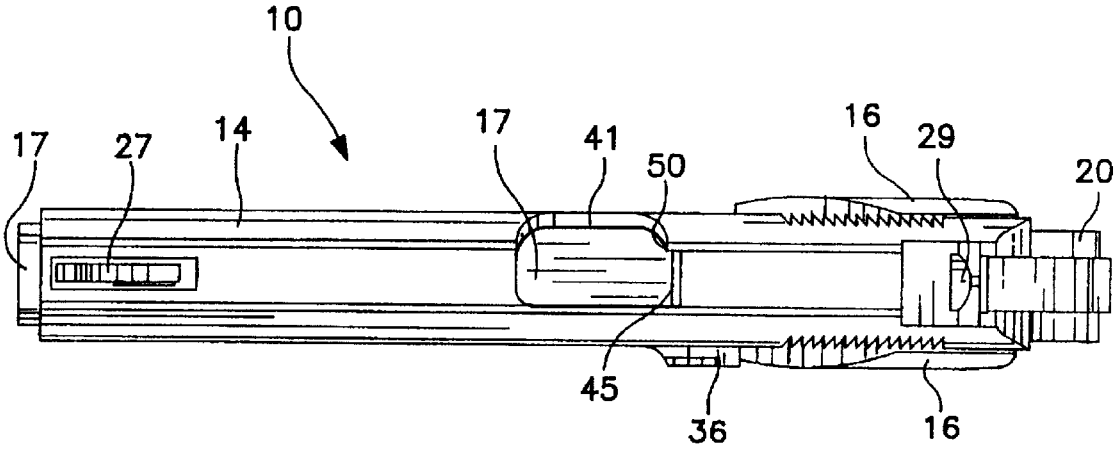
FIG. 3 is a is a top plan view of the pistol shown in FIG. 1.
Figure 4:
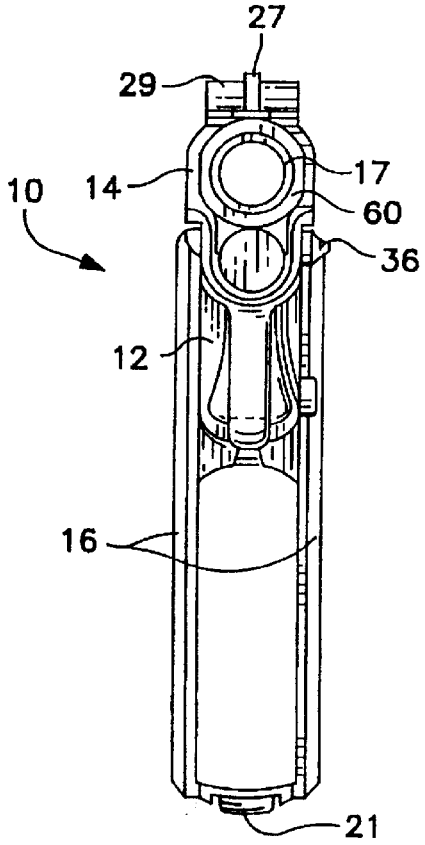
FIG. 4 is a front elevation of the pistol shown in FIG. 1.

Thus, in the assembled condition of the pistol 10, as seen in FIG. 1, the pin 34 of the slide stop 36 extends through a pair of holes, only one of which is shown at 38 in FIG. 2, in the sidewalls of the receiver 12 and through an pin-receiving hole 40 in the lower end of the link 30. Other views of the pistol are shown in FIGS. 3 and 4. Note particularly the shell-ejection opening 41 in the top of the slide 14, through which barrel 17 is visible. A hood recess 45 is formed in the aft end of shell-ejection opening 41.

The pistol 10 is disassembled to the state shown in FIG. 2 by removing them slide stop 36 from the receiver 12 and sliding the slide 14 along with the barrel 17 along the guide rails 22 until it slides free of the receiver 12. The recoil spring, recoil spring plug and recoil spring guide (not shown) are also removed from the receiver along with the slide 14.

Figure 5:
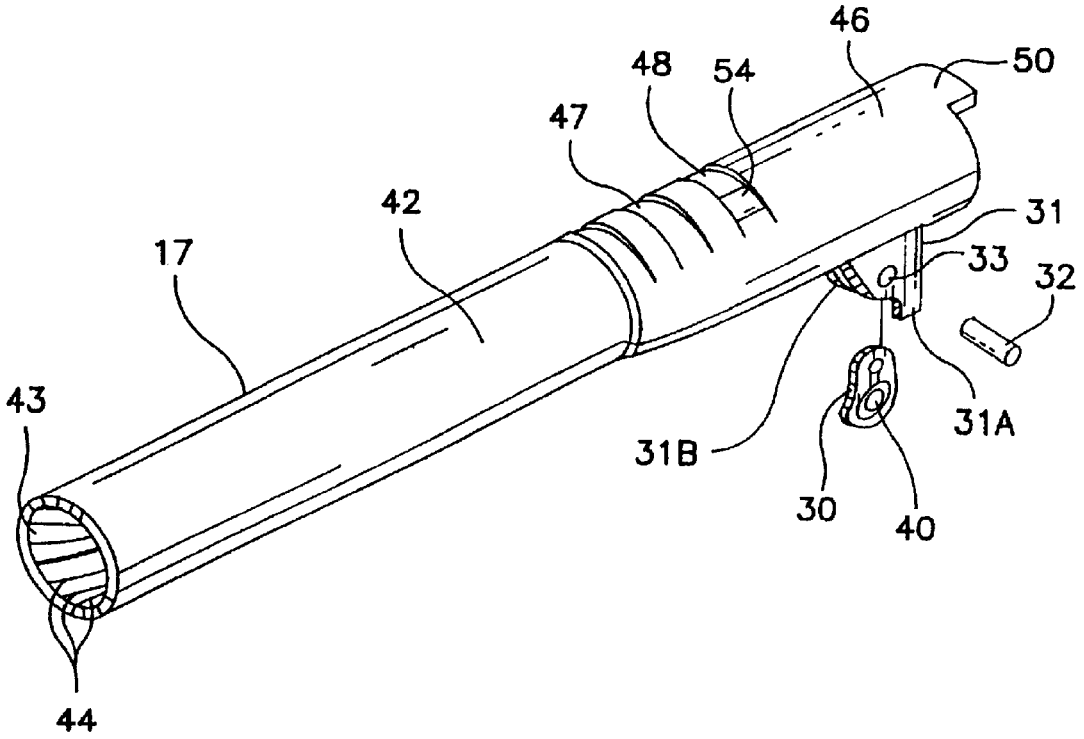
FIG. 5 is perspective view of the pistol barrel according to an embodiment of the present invention, with parts broken away for clarity.

Referring now to FIG. 5, the barrel 17 is shown in further detail. Barrel 17 includes a cylindrical barrel portion 42 having a central bore 43 with rifling grooves 44. An enlarged and integrally-formed locking portion 46 carries fore and aft locking grooves 47 and 48, and an aft-extending hood 50. As is best shown in FIG. 3, the hood 50 fits into the hood recess 45 of the shell-ejection opening 41.

The link lug 31 of the barrel 17 is formed of two laterally-spaced link lug legs 31A, 31B which support between them the link 30. As also shown in FIG. 5, the link 30 is pivotally mounted onto the link lug legs 31A, 31B by pin 32 positioned in a pin receiving hole 33.

The slide 14 includes a pair of fore-and-aft locking grooves 15 and 19 formed in, the interior walls of the slide 14 into which the barrel 17 fits.

Areas of the interior walls of the slide 14 adjacent the locking grooves 15 and 19 define wall segments which fit into the barrel locking grooves 47 and 48.

Figure 6:
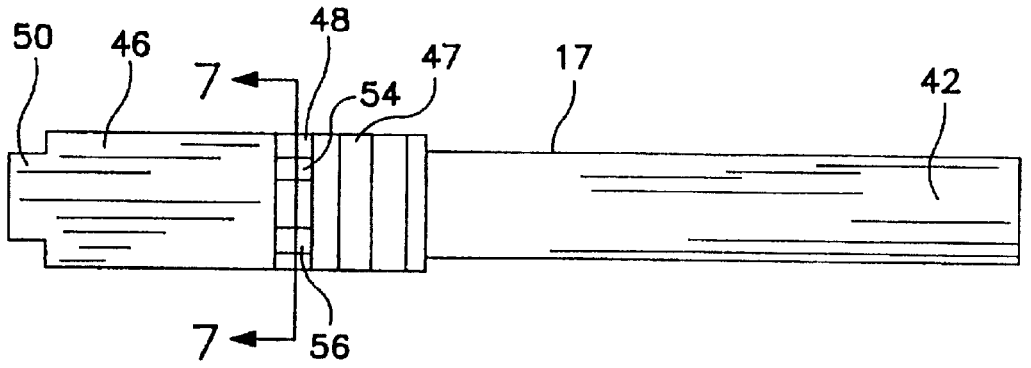
FIG. 6 is a top plan view of the barrel shown in FIG. 5.

As is best shown in FIGS. 5 and 6, the aft barrel locking groove 48 includes a pair of laterally-spaced contact pads 54, 56. These pads 54, 56 are integrally-formed in the barrel during machining. The pads 54, 56 are raised above the annular surface of the groove 48 and extend the fore-to-aft dimension of the groove 48. The contact pads 54, 56 each span an arc of 15 degrees, and from centerline-to-centerline are 90 degrees of arc on radii from the longitudinal centerline axis of the barrel 17. The purpose of these pads is explained in further detail in applicant's U.S. Pat. No. 5,753,848.

Figure 9:
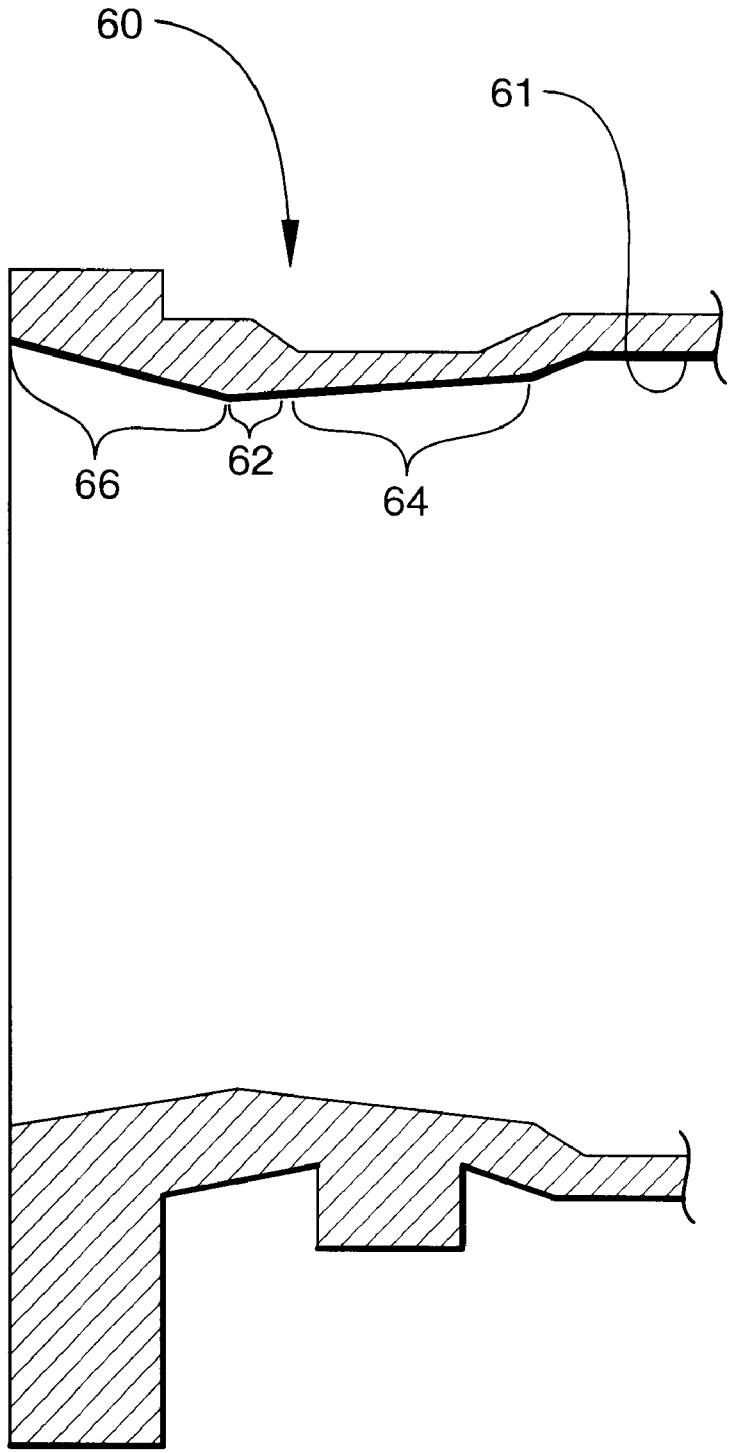
FIG. 9 is a vertical cross-section of a bushing according to an embodiment of the invention disclosed herein.

The pistol 10 also includes a barrel bushing 60, as is best shown in FIGS. 1 and 9. Barrel bushing 60 is fitted into the slide 14 and supports the exit end of the barrel 17.

Figure 7:
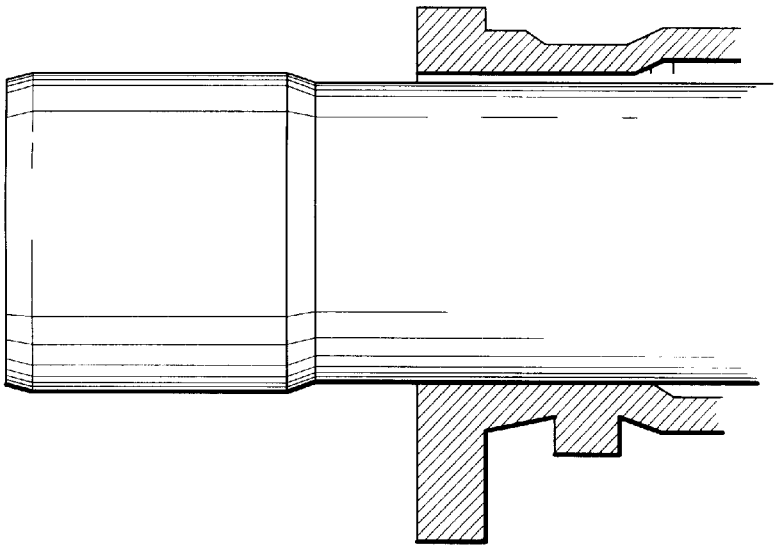
Fig. 7 (Prior Art)
FIG. 7 is a partial vertical cross-section of a prior art barrel muzzle and barrel bushing during the recoil phase of firing.
Figure 8:
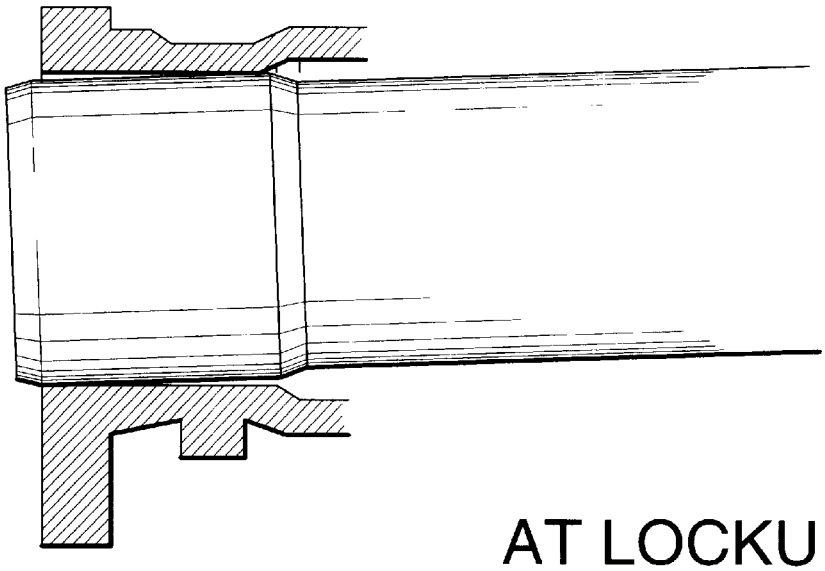
Fig. 8 (Prior Art)
FIG. 8 is a partial vertical cross-section of a prior art barrel muzzle and barrel bushing during the lockup phase of firing.

As is shown with reference to the prior art barrel bushing shown in FIGS. 7 and 8, the inner bore of the barrel bushing is essentially cylindrical, and parallel to the longitudinal axis of the barrel in recoil (FIG. 7), and therefore bears against the barrel over a large surface area. Conversely, when the barrel is in lockup (FIG. 8), thee barrel bears against two very small areas—the forward, bottom and rearward, top sides of the barrel.

The design shown in FIGS. 7 and 8 is difficult to properly fit, because the relatively long length of the cylindrical bearing surface will not allow the barrel to cam up properly during lockup if too tight, and will try to spring the rear of the barrel back out of lockup. This condition can cause the whole slide assembly to stop short of full lockup and cause vertical stringing of the shot group. In extreme cases, the muzzle of the barrel can be deformed, destroying any possibility of accuracy.

Figure 10:
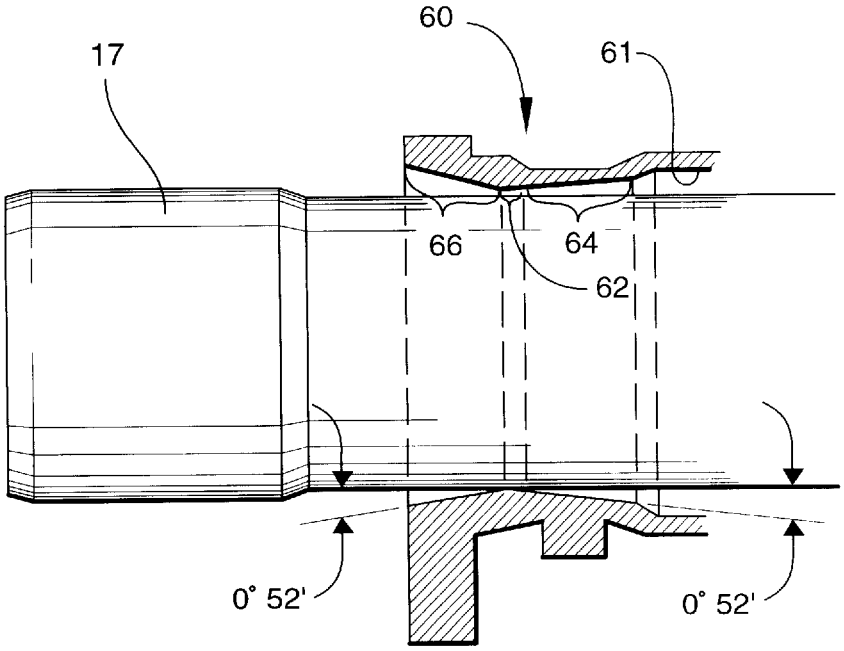
FIG. 10 is a vertical cross-section of a bushing according to an embodiment of the invention disclosed herein with the barrel positioned therein during recoil.
Figure 11:
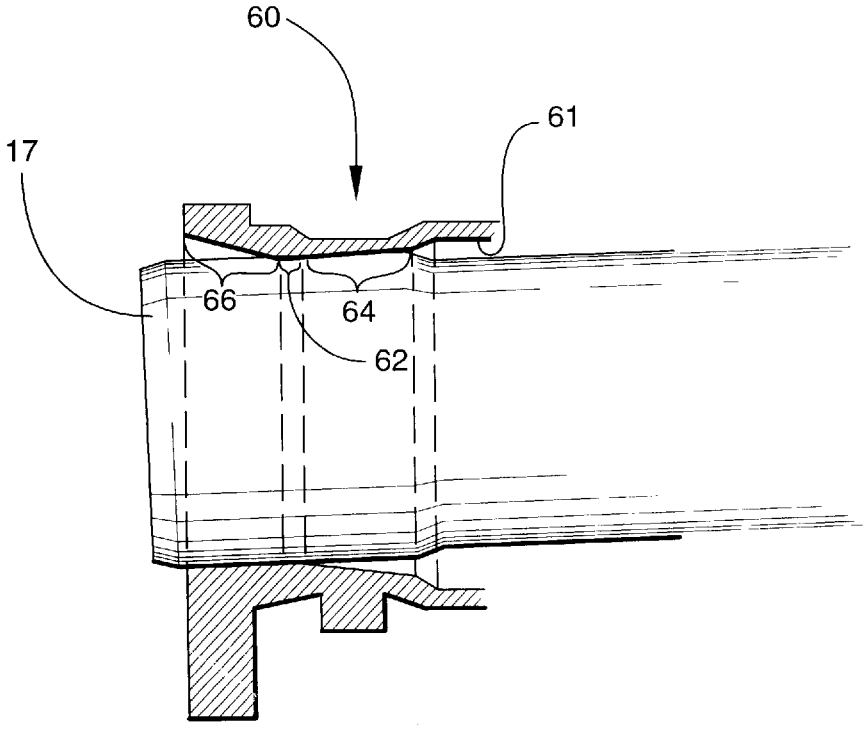
FIG. 11 is a vertical cross-section of the bushing shown in FIG. 10 with tile barrel positioned therein during lockup.

Referring now to FIGS. 9, 10 and 11, the barrel bushing 60 according to, the invention includes a through bore 61 and three distinct annular bearing surfaces 62, 64 and 66 o a the inner surface of the barrel bushing 60 defining the bore 61. The annular bearing surfaces are preferably formed by precision machining.

Bearing surface 62 is parallel to the longitudinal axis of the barrel bushing 60 (FIG. 9) and to the longitudinal axis of the barrel 17 when the barrel is in recoil (FIG. 10). Bearing surfaces 64 and 66 reside in axially spaced-apart relation on opposite axially-extending sides of the bearing surface 62 and define very shallow respective angles with respect to the bearing surface 62. These angles are parallel to the longitudinal axis of the barrel 17 during lockup and support opposite upper and lower surfaces of the barrel 17 during lockup. In the embodiment disclosed herein, the angle of each of the bearing surfaces 64 and 66 is 0°52' with respect to the bearing surface 62,. The axial length of bearing surface 62 is 0.03." The axial length of bearing surface 64 is 0.135." The axial length of bearing surface 66 is 0.135." Of course, other dimensions are possible and are determined by factors such as weapon condition, age, firing conditions and other considerations known to those of skill in the art.

As is shown in FIG. 10, the barrel 17 recoils while bearing against the relatively small surface area of the center bearing surface 62. When in lockup, the barrel 17 is supported by the relatively large surface areas of the bearing surfaces 64 and 66 along their entire length, as shown in FIG. 11. These relatively large surface areas provide stable positioning to the barrel 17 and prevent pinching or springing of the barrel 17, which can occur with prior art barrel bushings.

In the present invention wear to the barrel 17 and the barrel bushing 60 is reduced, since the barrel 17 is supported over the large surface areas of the bearing surfaces 64 and 66, and does not contact these surfaces during recoil.

A semiautomatic pistol barrel with precision adjustment means and method of precision-adjusting semi-automatic pistols is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. In a barrel bushing in combination with a semi-automatic pistol, the barrel bushing defining a bore for receiving a pistol barrel therein for reciprocating movement during operation of the pistol, the improvement comprising:

(a) first, second and third annular bearing surfaces formed on inner walls of the bore and adapted to move against the barrel during operation of the pistol;

(b) the first bearing surface contacting and supporting the barrel during the recoil phase of operation, the first bearing surface defining a plane parallel to the longitudinal axis of the barrel during recoil; and (c) the second and third bearing surfaces residing in axially spaced-apart relation on opposite axially-extending sides of the first bearing surface and defining respective planes which are parallel to the longitudinal axis of the barrel during lockup and on which opposites upper and lower surfaces of the barrel are supported during lockup.

2. In a barrel bushing in combination with a semi-automatic pistol according to claim 1, wherein first bearing surface defines an axial length which is 22 percent the length of each of the second and third bearing surfaces.

3. In a barrel bushing in combination with a semi-automatic pistol according to claim 1, wherein said second and third bearing surfaces each reside at all angle of 0°52' with reference to the first bearing surface.

4. In a semi-automatic pistol, the combination of a barrel bushing, the barrel bushing defining a bore for receiving a barrel therein for reciprocating movement during operation of the pistol, the improvement comprising:

(a) first, second and third annular bearing surfaces formed on inner walls of the bore and against which the barrel moves during operation of the pistol;

(b) the first bearing surface contacting and supporting the barrel during the recoil phase of operation, the first bearing surface defining a plane parallel to the longitudinal axis of the barrel during recoil;

(c) the second and third bearing surfaces residing in axially spaced-apart relation on opposite axially-extending sides of the first bearing surface and defining respective planes with respect to the first bearing surface which are parallel to the longitudinal axis of the barrel during lockup and on which opposite upper and lower surfaces of the barrel are supported during lockup.

5. In a semi-automatic pistol according to claim 4, wherein first bearing surface defines an axial length which is 22 percent the length of each of the second and third bearing surfaces.

6. In a semi-automatic pistol according to claim 5, wherein said second and third bearing surfaces each reside at an angle of 0°52' with reference to the first bearing surface.

7. The semi-automatic pistol according to claims 4, 5 or 6, wherein the pistol comprises a Colt 45 caliber semi-automatic pistol.

8. A method of manufacturing a barrel bushing of a semiautomatic pistol, the barrel bushing defining a bore adapted for receiving a pistol barrel therein for reciprocating movement during operation of the pistol, comprising the steps of:

(a) forming a first annular bearing surface contacting and supporting the barrel during the recoil phase of operation, the first bearing surface defining a plane parallel to the longitudinal axis of the barrel during recoil;

(b) forming second and third annular bearing surfaces in axially spaced-apart relation to each other on opposite axially-extending sides of the first bearing surface and defining respective planes which are parallel to the longitudinal axis of the barrel during lockup and on which opposite upper and lower surfaces of the barrel are supported during lockup.

9. A method according to claim 8, wherein the step of forming the first bearing surface comprises the step of forming the first bearing surface having an axial length which is 22 percent the length of each of the second and third bearing surfaces.

10. A method according to claim 8, wherein the step of forming reach of the second and third bearing surfaces comprises the step of forming said second and third bearing surfaces at an angle of 0°52' with reference to the first bearing surface.

11. A method according to claim 8, wherein the pistol comprises a Colt 45 caliber semi-automatic pistol.

12. A method according to claim 8, wherein the first, second and third bearing surfaces are each formed by machining.

* * * * *